US010138443B2

(12) United States Patent
Keenan et al.

(10) Patent No.: US 10,138,443 B2
(45) Date of Patent: Nov. 27, 2018

(54) CLEANING COMPOSITION WITH RAPID FOAM COLLAPSE

(71) Applicant: ROHM AND HAAS COMPANY, Philadelphia, PA (US)

(72) Inventors: Andrea C. Keenan, Plymouth Meeting, PA (US); Jan E. Shulman, Newtown, PA (US); Theodore Tysak, Ambler, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 15/038,548

(22) PCT Filed: Nov. 21, 2014

(86) PCT No.: PCT/US2014/066821

§ 371 (c)(1),
(2) Date: May 23, 2016

(87) PCT Pub. No.: WO2015/084610

PCT Pub. Date: Jun. 11, 2015

(65) Prior Publication Data

US 2016/0298059 A1 Oct. 13, 2016

Related U.S. Application Data

(60) Provisional application No. 61/912,280, filed on Dec. 5, 2013.

(51) Int. Cl.

| | |
|---|---|
| ***C11D 1/66*** | (2006.01) |
| ***C11D 1/72*** | (2006.01) |
| ***C11D 3/20*** | (2006.01) |
| ***C11D 11/00*** | (2006.01) |
| ***B08B 3/04*** | (2006.01) |
| ***C11D 3/18*** | (2006.01) |

(52) U.S. Cl.
CPC ..... *C11D 3/188* (2013.01); *C11D 3/2037* (2013.01); *C11D 3/2068* (2013.01); *C11D 3/2093* (2013.01); *C11D 11/0023* (2013.01)

(58) Field of Classification Search
CPC .. C11D 1/66; C11D 1/72; C11D 3/188; C11D 3/20; C11D 3/2037; C11D 3/2068; C11D 11/00; B08B 3/04
See application file for complete search history.

(56) References Cited

U.S. PATENT DOCUMENTS

| | | | | |
|---|---|---|---|---|
| 4,414,128 | A | 11/1983 | Goffinet | |
| 5,264,364 | A | 11/1993 | Donovan et al. | |
| 5,580,848 | A | 12/1996 | Drapier | |
| 5,854,193 | A | 12/1998 | Mondin et al. | |
| 5,854,197 | A | 12/1998 | Duccini et al. | |
| 5,877,133 | A | 3/1999 | Good | |
| 5,981,462 | A | 11/1999 | Mertens | |
| 5,994,287 | A | 11/1999 | Mertens et al. | |
| 6,004,919 | A | 12/1999 | Mertens | |
| 6,025,318 | A | 2/2000 | Mertens | |
| 6,048,834 | A | 4/2000 | Drapier et al. | |
| 6,136,773 | A | 10/2000 | Mertens | |
| 6,191,090 | B1 | 2/2001 | Mondin et al. | |
| 6,288,019 | B1 | 9/2001 | Mertens et al. | |
| 6,291,418 | B1 | 9/2001 | Mertens et al. | |
| 6,440,910 | B1 | 8/2002 | Smith et al. | |
| 9,279,096 | B2 | 3/2016 | Shulman et al. | |
| 2002/0045559 | A1 | 4/2002 | Forth et al. | |
| 2007/0086971 | A1 | 4/2007 | Diet et al. | |
| 2007/0232516 | A1 | 10/2007 | Anthony et al. | |
| 2011/0190187 | A1 | 8/2011 | Hawes, III et al. | |
| 2013/0269727 | A1* | 10/2013 | Kinnaird | C11D 1/72 134/6 |

FOREIGN PATENT DOCUMENTS

| | | | | |
|---|---|---|---|---|
| EP | 0883680 | B2 | 12/2005 | |
| EP | 1607472 | A1 | 12/2005 | |
| EP | 2029710 | B1 | 7/2010 | |
| GB | 2429015 | A | 2/2007 | |
| WO | 0204589 | A1 | 1/2002 | |
| WO | WO 02/04589 | * | 1/2002 | C11D 17/00 |
| WO | 2006004721 | A1 | 1/2006 | |
| WO | 2006007371 | A1 | 1/2006 | |

OTHER PUBLICATIONS

DOW product literature "ECOSURF(TM) EH Specialty Surfactants", Form No. 119-02244-0309 AMS, published Jan. 2009, pp. 1-16.
International Preliminary Report on Patentability for PCT/US2014/066821, international filing date of Nov. 21, 2014, dated Mar. 31, 2016, 22 pages.
International Search Report for PCT/US2014/066821, international filing date of Nov. 21, 2014, dated Feb. 4, 2015, 5 pages.
Written Opinion for PCT/US2014/066821, international filing date of Nov. 21, 2014, dated Feb. 4, 2015, 6 pages.
Xu et al. "Six Step Design of Detergent Formula," Chemical Industry Press, Apr. 2010, pp. 132-133.

* cited by examiner

*Primary Examiner* — Brian P Mruk

(57) ABSTRACT

An aqueous cleaning composition including: a surfactant; a first compound that is immiscible with water and has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$; and a second compound that is miscible with water and has Hansen solubility parameters of 10 $MPa^{0.5} \leq \delta_D \leq 22$ $MPa^{0.5}$, $0 \leq \delta_P \leq 10$ $MPa^{0.5}$, and $0 \leq \delta_H \leq 14$ $MPa^{0.5}$, wherein the surfactant, the first compound, and the second compound are each independently included in an amount of 0.01 to 30 weight percent, based on a total weight of the cleaning composition.

12 Claims, No Drawings

CLEANING COMPOSITION WITH RAPID FOAM COLLAPSE

CROSS REFERENCE TO RELATED APPLICATIONS

This application is a National Stage application of PCT/US2014/066821, filed Nov. 21, 2014, which claims the benefit of U.S. Provisional Application No. 61/912,280, filed Dec. 5, 2013, both of which are incorporated by reference in their entirety herein.

BACKGROUND

Disclosed is a cleaning composition suitable for hard surfaces which provides rapid foam collapse, and a method of manufacturing the composition.

Consumers associate foaming of hard surface cleaners as being related to the efficiency and effectiveness of the cleaner. Thus it is desirable for a cleaner to initially foam to indicate cleaning power or efficacy. Foaming may be enhanced by agitation, such as that provided by a spray applicator. It is also desirable for the foam to rapidly collapse to signal cleaner function and to indicate desirable rinse properties. Thus there remains a need for a cleaning composition with desirable foaming and foam collapse properties.

SUMMARY

Disclosed is an aqueous cleaning composition including: a surfactant; a first compound that is immiscible with water and has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$, and a second compound that is miscible with water and has Hansen solubility parameters of 10 $MPa^{0.5} \leq \delta_D \leq 22$ $MPa^{0.5}$, $0 \leq \delta_P \leq 10$ $MPa^{0.5}$, and $0 \leq \delta_H \leq 14$ $MPa^{0.5}$, wherein the surfactant, the first compound, and the second compound are each independently included in an amount of 0.01 to 30 weight percent, based on a total weight of the cleaning composition.

Also disclosed is a method of manufacturing an aqueous cleaning composition, the method including combining a surfactant, a first compound that is water immiscible and has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$, and a second compound that is water miscible and has Hansen solubility parameters of 10 $MPa^{0.5} \leq \delta_D \leq 22$ $MPa^{0.5}$, $0 \leq \delta_P \leq 10$ $MPa^{0.5}$, and $0 \leq \delta_H \leq 14$ $MPa^{0.5}$ to manufacture the cleaning composition.

Also disclosed is a method of cleaning a surface including contacting the surface with the cleaning composition; and removing soil and the cleaning composition from the surface.

DETAILED DESCRIPTION

Disclosed is an aqueous cleaning composition that is suitable for cleaning hard surfaces, such as countertops and floors that provides improved foam formation and collapse properties. The aqueous cleaning composition comprises a surfactant, a first compound that is water immiscible, e.g., non-soluble, and a second compound that is water miscible, e.g., water soluble. It has been discovered that a composition wherein the first compound has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$, and wherein the second compound has Hansen solubility parameters of 10 $MPa^{0.5} \leq \delta_D \leq 22$ $MPa^{0.5}$, $0 \leq \delta_P \leq 10$ $MPa^{0.5}$, and $0 \leq \delta_H \leq 14$ $MPa^{0.5}$ provides unexpectedly improved foam formation and collapse properties.

Also, further improved foam formation and collapse properties are provided if the surfactant is a nonionic C2 to C4 alkylene oxide condensate of a C6 to C22 aliphatic alcohol. The aqueous cleaning composition may be in the form of an emulsion. While not wanting to be bound by theory, it is believed that the improved foam formation and collapse properties occur because a microemulsion generates or forms a foam when the cleaning composition is dispensed, and the first compound that is immiscible with water, migrates to the surface of surfactant micelles during foam formation, resulting in the desirable foam collapse properties. The surfactant, the first compound, and the second compound are each independently included in an amount of 0.01 to 30 weight percent, specifically 0.1 to 20 weight percent, more specifically 0.2 to 10 weight percent, based on a total weight of the cleaning composition.

The surfactant may comprise a nonionic surfactant, an anionic surfactant, a cationic surfactant, a zwitterionic surfactant, or a combination thereof. Representative anionic surfactants include, for example, a C10 to C16 alkylbenzenesulfonate, such as a linear C8 to C12 alkylbenzenesulfonate, such as sodium dodecylbenzenesulfonate, a C6 to C18 alkyldiphenyloxide disulfonate, a C12 to C16 alcohol sulfate, an ethoxylated C12 to C16 alcohol sulfate, a hydroxy alkylsulfonate, a C12 to C16 alkenyl- or C12 to C16 alkylsulfate or sulfonate, a monoglyceride sulfate, a C12 to C16 alkyl sulfosuccinate, or an acid condensate of a fatty acid chloride with a hydroxy alkylsulfonate. In an embodiment, the anionic surfactant may be an alkyldiphenyloxide disulfonate compound of the formula

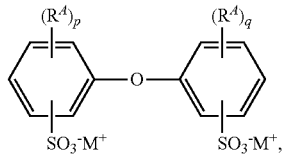

wherein $R^A$ at each occurrence is independently $C_6$ to $C_{18}$ alkyl, $M^+$ is $H^+$ or a monovalent cation, and p and q are independently 0 or 1 provided that at least one of p and q is 1. In an embodiment, p is 0 and $R^A$ is $C_{12}$ alkyl or $C_{16}$ alkyl.

Representative cationic surfactants include, for example, a C16 to C18 dialkyldimethylammonium chloride or a C8 to C18 alkyldimethylbenzylammonium chloride. Zwitterionic surfactants include, for example, an aliphatic quaternary ammonium compound such as 3-(N,N-dimethyl-N-hexadecyl-ammonio)propane-1-sulfonate or 3-(N,N-dimethyl-N-hexadecylammonio)-2-hydroxypropane-1-sulfonate. Amphoteric surfactants include, for example, a betaine, a sulfobetaine, a fatty acid imidazole carboxylate, or a sulfonate.

Non-ionic surfactants are preferred. The nonionic surfactant may comprise, for example, a C2 to C4 alkylene oxide condensate of: a mono- or polyhydroxy substituted or unsubstituted C6 to C22 aliphatic alcohol, a substituted or unsubstituted C6 to C12 alkyl phenol, a fatty acid amide, or a fatty amine; an alkyl saccharide, an amine oxide, a sugar derivative such as sucrose monopalmitate, glucamine, a long chain tertiary phosphine oxide, a dialkyl sulfoxide, a fatty acid amide such as a mono- or diethanol amide of a C10 to C18 fatty acid, or a combination thereof.

The nonionic alkoxylated alcohol surfactant may be an alkylene oxide condensation product of an aliphatic or aromatic alcohol with 1 to 75 moles, specifically 1 to 50 moles, more specifically 1 to 15 moles, or 2 to 9 moles of alkylene oxide per mole of the alcohol. An embodiment in which the alkylene oxide is a C2 to C4 alkylene oxide, more specifically ethylene oxide and/or propylene oxide, is specifically mentioned. An ethoxylated and/or propoxylated unsubstituted C6 to C22 aliphatic alcohol or an ethoxylated and/or propoxylated unsubstituted C6 to C12 alkyl phenol may be used. The alkyl chain of the aliphatic alcohol or the alkyl group of the alkyl phenol can either be straight or branched, primary or secondary, and may contain 6 to 22 carbon atoms, specifically 8 to 20 carbon atoms. Specifically mentioned is a condensation product of an alcohol having an alkyl group containing from 6 to 20 carbon atoms and 2 to 9 moles of ethylene oxide and propylene oxide per mole of alcohol. The surfactant may have a hydrophilic-lipophilic balance of 8 to 14, specifically 8.5 to 13.5, more specifically 9 to 13. Use of a 2-ethyl hexanol ethylene oxide-propylene oxide non-ionic surfactant is specifically mentioned.

The alkyl saccharide may comprise a C6 to C18 alkyl group, specifically a C8 to C16 alkyl group, and a saccharide or polysaccharide group, e.g., a glucoside or polyglucoside hydrophilic group. The alkyl saccharide may be an alkyl glucoside and may comprise 1 to 10, specifically 1.2 to 5, or 1.3 to 3 saccharide units. Optionally, the alkyl glucoside may comprise an alkyleneoxide group joining the hydrophobic moiety and the polysaccharide moiety. A suitable alkyleneoxide is ethylene oxide. The alkyl group of the alkyl saccharide may be saturated or unsaturated, and branched or unbranched. The alkyl group can contain up to about 3 hydroxy groups and/or the alkylene oxide group can contain 1 to 10, or 2 to 5, alkylene oxide moieties. Representative alkyl polysaccharides are octyl, nonyldecyl, undecyldodecyl, tridecyl, tetradecyl, pentadecyl, hexadecyl, heptadecyl, and octadecyl, di-, tri-, terra-, penta-, and hexaglucosides, galactosides, lactosides, glucoses, fructosides, fructoses and/or galactoses. Representative combinations include coconut alkyl, di-, tri-, terra-, and pentaglucosides and tallow alkyl terra-, penta-, and hexaglucosides. Alkyl glucosides or polyglucosides comprising a C8 to C16, specifically a C8 to C10 alkyl group are specifically mentioned.

Representative amine oxides include dimethyl-dodecylamine oxide, oleyldi(2-hydroxyethyl) amine oxide, dimethyltetradecylamine oxide, di(2-hydroxyethyl)-tetradecylamine oxide, dimethylhexadecylamine oxide, behenamine oxide, cocamine oxide, decyltetradecylamine oxide, dihydroxyethyl C12 to C15 alkoxypropylamine oxide, dihydroxyethyl cocamine oxide, dihydroxyethyl lauramine oxide, dihydroxyethyl stearamine oxide, dihydroxyethyl tallowamine oxide, hydrogenated palm kernel amine oxide, hydrogenated tallowamine oxide, hydroxyethyl hydroxypropyl C12 to C15 alkoxypropylamine oxide, lauramine oxide, myristamine oxide, myristyl/cetyl amine oxide, oleamidopropylamine oxide, oleamine oxide, palmitamine oxide, PEG-3 lauramine oxide, dimethyl lauramine oxide, potassium trisphosphonomethylamine oxide, stearamine oxide, and tallowamine oxide. In an embodiment, the amine oxide is lauramine oxide.

Representative commercially available surfactants include ECOSURF™ EH3, ECOSURF™ EH6, ECOSURF™ EH9, ECOSURF™ EH14, ECOSURF™ SA4, ECOSURF™ SA7, ECOSURF™ SA9, TRITON™ CG50, TRITON™ CG-110, TRITON™ CG425, TRITON™ CG600, TRITON™ 650, TRITON™ BG-10, TRITON™ DF16, TRITON™ CF10, TRITON™ LF20, TRITON™ X45, MINFOAM™ 1X, MINFOAM™ 2X, TERGITOL 15-S-7, and TERGITOL 15-S-9, each of that is available from the Dow Chemical Company, and GLUCOPON™ 215 P, GLUCOPON™ 215 UP, GLUCOPON™ 225 DK, GLUCOPON™ 325 N, GLUCOPON™ 425 N/HH, GLUCOPON™ 625 UP, GLUCOPON™ 650, each of that is available from the BASF company.

The first compound and the second compound may have selected Hansen solubility parameters. There are three Hansen solubility parameters. While not wanting to be bound by theory, $\delta_D$ is understood to characterize the energy from dispersion forces between molecules, $\delta_P$ is understood to characterize the energy from dipolar intermolecular force between molecules, and $\delta_H$ is understood to characterize the energy from hydrogen bonds between molecules. It has been discovered that use of a first compound has Hansen solubility parameters of $10\ MPa^{0.5} \leq \delta_D \leq 22\ MPa^{0.5}$, $0 \leq \delta_P \leq 14\ MPa^{0.5}$, and $0 \leq \delta_H \leq 14\ MPa^{0.5}$, and a second compound having Hansen solubility parameters of $10\ MPa^{0.5} \leq \delta_D \leq 22\ MPa^{0.5}$, $0 \leq \delta_P \leq 10\ MPa^{0.5}$, and $0 \leq \delta_H \leq 14\ MPa^{0.5}$ provides desirable results. The first compound may have Hansen solubility parameters of $12\ MPa^{0.5} \leq \delta_D \leq 18\ MPa^{0.5}$, $0 \leq \delta_P \leq 12\ MPa^{0.5}$, and $0 \leq \delta_H \leq 9\ MPa^{0.5}$, specifically $15\ MPa^{0.5} \leq \delta_D \leq 17\ MPa^{0.5}$, $0 \leq \delta_P \leq 4\ MPa^{0.5}$, and $0 \leq \delta_H \leq 5\ MPa^{0.5}$. Also, the second compound may have Hansen solubility parameters of $12\ MPa^{0.5} \leq \delta_D \leq 18\ MPa^{0.5}$, $1 \leq \delta_P \leq 9\ MPa^{0.5}$, and $5 \leq \delta_H \leq 13\ MPa^{0.5}$, specifically $14\ MPa^{0.5} \leq \delta_D \leq 17\ MPa^{0.5}$, $1 \leq \delta_P \leq 7\ MPa^{0.5}$, and $7 \leq \delta_H \leq 12\ MPa^{0.5}$.

Furthermore, it has been unexpectedly observed that avoiding use of a second compound having Hansen solubility parameters of $\delta_P$ greater than 7.1 and $\delta_H$ greater than 12.1 provides desirable results. Thus, in an embodiment, the second compound of the cleaning composition has a $\delta_P$ less than 7.1 and a $\delta_H$ less than 12.1. For example, compositions including propylene glycol methyl ether as a second compound that has a $\delta_P$ of 7.2 and $\delta_H$ of 13.6, or ethylene glycol propyl ether that has a $\delta_P$ of 8 and $\delta_H$ of 13.1, are lower performing.

The first compound is immiscible with water. The first compound may be a compound of Formula 1, a substituted or unsubstituted terpene, or a combination thereof.

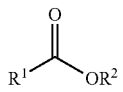

(1)

In Formula 1, $R^1$ is a substituted or unsubstituted C7 to C18 alkyl group, specifically a C8 to C14 alkyl group, and $R^2$ is a substituted or unsubstituted C1 to C6 alkyl group, specifically a C2 to C4 alkyl group, or a combination thereof. The terpene may be a hemiterpene, a monoterpene, a sesquiterpene, or a combination thereof. Representative monoterpenes include limonene, pinene, terpinene, sabinene, thujene, mercene, ocimeme, nerol, or geraniol. Representative sesquiterpenes include aromadendrene, caryophyllene, longifolene, valencene, isobazzanene, silphinene, ishwarane, isopatchchoul-3-ene, isosesquicarene, or a combination thereof. The terpene d-limonene is specifically mentioned. Examples of the compound of Formula 1 include ethyl octanoate, butyl octanoate, ethyl decanoate, isopropyl myristate, ethyl laurate, or a combination thereof. Also mentioned are biologically derived materials such as esters of methanol and soy acid, e.g., methyl soyate. Ethyl laurate is specifically mentioned.

As noted above, the first compound has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$. Hansen solubility parameters and the molecular weight of d-limonene, ethyl octanoate, butyl decanoate, and ethyl laurate are provided in Table 1.

TABLE 1

| First Compound | $\delta_P$ | $\delta_H$ | $\delta_D$ | Mw |
|---|---|---|---|---|
| d-Limonene | 0.6 | 0 | 16.5 | 152.24 |
| Ethyl Octanoate | 3.9 | 4.5 | 15.9 | 172.27 |
| Butyl Decanoate | 2.9 | 4.1 | 16.1 | 228.37 |
| Ethyl Laurate | 2.9 | 4.1 | 16.1 | 228.37 |

The second compound is miscible with water and comprises a compound of Formula 2, $$R^3—(OC_nH_{2n})_zOX \quad (2)$$

wherein $R^3$ is a substituted or unsubstituted C1 to C12 aliphatic group, a substituted or unsubstituted C6 to C12 aryl group, a group of the formula —C(=O)$C_6H_5$, or a group of the formula —C(=O)$CH_3$, n is 2 to 4, z is 1 to 4, and X is —H, —CH3, —C(=O)CH3, or —C(=O)$C_6H_5$. In an embodiment, $R^3$ is a substituted or unsubstituted C1 to 10 aliphatic group, specifically an unsubstituted C2 to C10 alkyl group, more specifically an unsubstituted C2 to C6 alkyl group. An embodiment in which n is 2 to 4, z is 1 to 3, and X is —H is specifically mentioned.

Representative examples of the second compound include tripropylene glycol methyl ether, dipropylene glycol n-butyl ether, tripropylene glycol n-butyl ether, dipropylene glycol n-propyl ether, dipropylene glycol phenyl ether, dipropylene glycol methyl ether acetate, propylene glycol n-propyl ether, diethylene glycol monobutyl ether, diethylene glycol n-butyl ether, diethylene glycol monohexyl ether, diethylene glycol hexyl ether, or a combination thereof. Other examples of the second compound may include dipropylene glycol methyl ether, propylene glycol methyl ether, propylene glycol methyl ether acetate, dipropylene glycol methyl ether acetate, or propylene glycol diacetate. The Hansen solubility parameters of selected water miscible compounds are provided in Table 2. Also, for comparison purposes included in Table 2 are propylene glycol methyl ether and ethylene glycol propyl ether. It is noted that propylene glycol methyl ether and ethylene glycol propyl ether each have $\delta_P$ greater than 7.1 and a $\delta_H$ greater than 12.1.

TABLE 2

| Second Compound | $\delta_P$ | $\delta_H$ | $\delta_D$ | Mw |
|---|---|---|---|---|
| Tripropylene glycol methyl ether | 2.5 | 8.7 | 15.1 | 206.3 |
| Dipropylene glycol n-butyl ether | 2.5 | 8.7 | 14.8 | 190.3 |
| Tripropylene glycol n-butyl ether | 1.7 | 7.9 | 14.8 | 248.4 |
| Dipropylene glycol n-propyl ether | 2.9 | 9.2 | 15 | 176.2 |
| Dipropylene glycol phenyl ether | 2.72 | 9 | 14.98 | 210.2 |
| Dipropylene glycol methyl ether acetate | 4.9 | 8 | 16.3 | 190.2 |
| Propylene glycol n-propyl ether | 5.6 | 12 | 15.4 | 118.2 |
| Diethylene glycol n-butyl ether | 7 | 10.6 | 16 | 162.2 |
| Diethylene glycol hexyl ether | 6 | 10 | 16 | 190.3 |
| Propylene glycol methyl ether | 7.2 | 13.6 | 15.6 | 90.1 |
| Ethylene glycol propyl ether | 8 | 13.1 | 16.1 | 104.2 |

It has also been unexpectedly found that compositions wherein the first compound and/or the second compound have a relatively low molecular weight, e.g., 80 to 750 Daltons (Da), provide particularly desirable foam collapse properties. The first and second compounds may each independently have a molecular weight of 80 to 750 Daltons (Da), specifically 90 to 650 Da, more specifically 100 to 550 Da. First and second compounds having a molecular weight of 100 to 300 Da are specifically mentioned.

The surfactant, the first compound, and the second compound may each independently be included in the composition in an amount from 0.01 to 30 weight percent (wt %). In an embodiment, the surfactant, the first compound, and the second compound are each independently included in the composition in an amount of 0.1 to 10 (wt %), specifically 0.2 to 8 wt %, more specifically 0.4 to 6 wt %, or 0.6 to 4 wt %, based on a total weight of the cleaning composition. An embodiment in which the surfactant is included in an amount of 3 wt %, the first compound is included in an amount of 1 wt %, and the second compound is included in an amount of 3 wt %, each based on a total weight of the cleaning composition, is specifically mentioned.

The water content of the aqueous cleaning composition may be 10 to 99 wt %, specifically 20 to 98 wt %, more specifically 40 to 97 wt %.

The cleaning composition may further comprise additional components, such as a salt, builder, additional surfactant, stabilizer, fragrance, enzyme, corrosion inhibitor, chelant, acid, solvent, bleaching agent, or combination thereof. The salt may be an alkali metal halide, such as sodium chloride or potassium chloride, an ammonium salt, a nitrate, a sulfate, a nitrite, or a combination thereof, for example. The salt may be contained in an amount of 0 to 20 wt %, specifically 0.1 to 10 wt %. The additional surfactant may be anionic, zwitterionic, amphoteric, or cationic, as is further disclosed above. The additional surfactant may be contained in an amount of 0 to 10 wt %, specifically 0.5 to 5 wt %.

Suitable builders include, for example, an inorganic builder such as alkali metal polyphosphate such as a tripolyphosphate or a pyrophosphate, ethylenediaminetetraacetic acid, nitrilotriacetate, an alkali metal carbonate, a borate, a bicarbonate, a hydroxide, a zeolite, or a combination thereof. The builder may include a water-soluble organic builder such as a citrate, a polycarboxylate, a monocarboxylate, aminotrismethylenephosphonic acid, hydroxyethanediphosphonic acid, diethylenetriaminepenta (methylenephosphonic acid), ethylenediaminetetraethylenephosphonic acid, and salts thereof, or an oligomeric or polymeric phosphonate. A combination comprising at least one of the foregoing can be used. The amount of the builder may be 0 to 50 wt %, specifically 0 to 30 wt %, more specifically 0 to 15 wt %, based on a total weight of the cleaning compositions.

Representative stabilizers, also referred to as compatibilizers, solubilizers or hydrotropes, include, for example, alcohols such as ethanol, n-propanol, or isopropanol, propylene glycol, glycol ethers, monoethanolamine, diethanolamine, triethanolamine, xylenesulfonate, cumenesulfonate and toluene-sulfonate. The amount of stabilizer may be 0 to 30 wt %, specifically 0.1 to 20 wt %, or 0.2 to 10 wt %, based on a total weight of the cleaning composition.

Corrosion inhibitors include, for example, sodium silicate, sodium disilicate, and sodium metasilicate, and may be used in amounts of 0 to 20 wt %, specifically 0 to 10 wt %, based on a total weight of the cleaning composition.

Bleaching agents include, for example, hydrogen peroxide or chlorine-generating substances, such as sodium hypochlorite or a chloroisocyanurate. The amount of bleaching agent may be 0 to 10 wt %, specifically 1 to 5 wt %, or 2 to 4 wt %, based on a total weight of the cleaning composition.

Suitable chelants include sodium gluconate, pentasodium salt of diethylenetriamine pentaacetic acid (available under the name Versenex 80), sodium glucoheptonate, ethylene diamine tetraacetic acid (EDTA), salts of ethylene diamine tetraacetic acid, hydroxyethyl ethylene diamine triacetic acid (HEDTA), salts of hydroxy ethyl ethylene diamine triacetic acid, nitrilotriacetic acid (NTA), salts of nitrilotriacetic acid, diethanolglycine sodium salt (DEG), ethanoldiglycine disodium salt (EDG), tetrasodium N,N-bis(carboxylatomethyl)-L-glutamate (GLDA), methylglycinediacetic acid (MGDA), and mixtures thereof. Exemplary salts of ethylene diamine tetraacetic acid include disodium salts, tetrasodium salts, diammonium salts, and trisodium salts. The amount of chelant may be 0 to 10 wt %, specifically 1 to 5 wt %, or 2 to 4 wt %, based on a total weight of the cleaning composition.

The acid may be an organic carboxylic acid, or a salt thereof, such as a C3 to C9 organic carboxylic acid, such as gluconic acid, lactic acid, citric acid, glycolic acid, acetic acid, propionic acid, succinic acid, glutaric acid, adipinic acid, butanedioic acid, isoascorbic acid, ascorbatic acid or tatric acid. The amount of the acid may be 0 to 10 wt %, specifically 1 to 5 wt %, or 2 to 4 wt %, based on a total weight of the cleaning composition.

Representative solvents include alcohols, glycols, glycol ethers, esters, or a combination thereof. Suitable alcohols include ethanol, propanol, isopropanol (propan-2-ol), 2-butoxy ethanol (butyl glycol), 1-decanol, benzyl alcohol, glycerin, monoethanolamine (MEA), or a combination thereof. Suitable glycols include ethylene glycol, diethylene glycol, triethylene glycol, tetraethylene glycol, glycerin, propylene glycol, dipropylene glycol, hexylene glycol, or a combination thereof. The amount of the solvent may be 0 to 50 wt %, specifically 1 to 25 wt %, or 2 to 10 wt %, based on a total weight of the cleaning composition.

Also disclosed is a method of manufacturing an aqueous cleaning composition, the method comprising combining the surfactant, the first compound that is water immiscible and has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$, and the second compound that is water miscible and has Hansen solubility parameters of 10 $MPa^{0.5} \leq \delta_D \leq 22$ $MPa^{0.5}$, $0 \leq \delta_P \leq 10$ $MPa^{0.5}$, and $0 \leq \delta_H \leq 14$ $MPa^{0.5}$ to manufacture the cleaning composition. The combining may be conducted in a batch or continuous fashion at any suitable rate.

Also disclosed is a method of cleaning a surface comprising contacting the surface with the cleaning composition and removing soil and the cleaning composition from the surface. The contacting the surface with the cleaning composition may comprise disposing the cleaning composition with a roller applicator, a brush, or a spray applicator.

"Substituted" means that the compound or group is substituted with at least one (e.g., 1, 2, 3, or 4) substituents independently selected from a hydroxyl (—OH), a C1-C9 alkoxy, a C1-C9 haloalkoxy, an oxo (=O), a nitro ($—NO_2$), a cyano (—CN), an amino ($—NH_2$), an azido ($—N_3$), an amidino ($—C(=NH)NH_2$), a hydrazino ($—NHNH_2$), a hydrazono ($=N—NH_2$), a carbonyl (—C(=O)—), a carbamoyl ($—C(O)NH_2$), a sulfonyl ($—S(=O)_2—$), a thiol (—SH), a thiocyano (—SCN), a tosyl ($CH_3C_6H_4SO_2—$), a carboxylic acid (—C(=O)OH), a carboxylic C1 to C6 alkyl ester (—C(=O)OR wherein R is a C1 to C6 alkyl group), a C1 to C12 alkyl, a C3 to C12 cycloalkyl, a C2 to C12 alkenyl, a C5 to C12 cycloalkenyl, a C2 to C12 alkynyl, a C6 to C12 aryl, or a C7 to C13 arylalkylene, instead of hydrogen, provided that the substituted atom's normal valence is not exceeded.

"Aliphatic" as used herein means a saturated or unsaturated linear or branched hydrocarbon. An aliphatic group may be an alkyl, alkenyl, or alkynyl group, for example. "Alkyl" as used herein means a straight or branched chain, saturated, monovalent hydrocarbon group (e.g., methyl or hexyl). "Alkylene" means a straight or branched chain, saturated, divalent aliphatic hydrocarbon group, (e.g., methylene ($—CH_2—$) or, propylene ($—(CH_2)_3—$)). "Aryl" means a monovalent group formed by the removal of one hydrogen atom from one or more rings of an arene (e.g., phenyl or napthyl).

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

In summary, disclosed is an aqueous cleaning composition comprising: a surfactant; a first compound that is immiscible with water and has Hansen solubility parameters of 10 $MPa^{0.5} \leq \delta_D \leq 22$ $MPa^{0.5}$, $0 \leq \delta_P \leq 14$ $MPa^{0.5}$, and $0 \leq \delta_H \leq 14$ $MPa^{0.5}$; and a second compound that is miscible with water and has Hansen solubility parameters of 10 $MPa^{0.5} \leq \delta_D \leq 22$ $MPa^{0.5}$, $0 \leq \delta_P \leq 10$ $MPa^{0.5}$, and $0 \leq \delta_H \leq 14$ $MPa^{0.5}$, wherein the surfactant, the first compound, and the second compound are each independently included in an amount of 0.01 to 30 weight percent, based on a total weight of the cleaning composition. In various embodiments (1) the surfactant may be a nonionic C2 to C4 alkylene oxide condensate of a substituted or unsubstituted C6 to C22 aliphatic alcohol, C2 to C4 alkylene oxide condensate of a substituted or unsubstituted C6 to C12 alkyl phenol, an alkyl saccharide, an amine oxide, or a combination thereof; and/or (2) the surfactant may be a C2 to C4 alkylene oxide condensate of an unsubstituted C6 to C22 aliphatic alcohol and comprises 2 to 9 moles of an alkylene oxide group per mole of the aliphatic alcohol; and/or (3) the alkylene oxide group may comprise an ethylene oxide group, a propylene oxide group, or a combination thereof; and/or (4) the surfactant may have a hydrophilic-lipophilic balance of 8 to 14; and/or (5) the first compound has Hansen solubility parameters of 15 $MPa^{0.5} \leq \delta_D \leq 17$ $MPa^{0.5}$, $0 \leq \delta_P \leq 4$ $MPa^{0.5}$, and $0 \leq \delta_H \leq 5$ $MPa^{0.5}$, and the second compound having Hansen solubility parameters of 14 $MPa^{0.5} \leq \delta_D \leq 17$ $MPa^{0.5}$, $1 \leq \delta_P \leq 7$ $MPa^{0.5}$, and $7 \leq \delta_H \leq 12$ $MPa^{0.5}$ and/or (6) the second compound may have a $\delta_P$ less than 7.1 and a $\delta_H$ less than 12.1; and/or (7) the first compound may be a substituted or unsubstituted terpene, a compound of Formula 1,

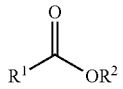

(1)

wherein $R^1$ is a substituted or unsubstituted C7 to C18 alkyl group and $R^2$ is a substituted or unsubstituted C1 to C6 alkyl group, or a combination thereof; and/or (8) $R^2$ may be an unsubstituted C2 to C4 alkyl group; and/or (9) the second compound may comprise a compound of Formula 2, $$R^3—(OC_nH_{2n})_zOX \quad (2)$$

wherein $R^3$ is a substituted or unsubstituted C1 to C12 aliphatic group, a substituted or unsubstituted C6 to C12 aryl group, a group of the formula —C(=O)$C_6H_5$, or a group of the formula —C(=O)$CH_3$, n is 2 to 4, z is 1 to 4, and X is —H, —$CH_3$, —C(=O)$CH_3$, or —C(=O)$C_6H_5$; and/or (10) $R^3$ may be an unsubstituted C2 to C6 alkyl group, n is 2 to 4, and z is 1 to 3; and/or (11) the first compound and the second compound may each independently have a molecular weight of 80 to 750 Daltons; and/or (12) the surfactant, the first compound, and the second compound may each independently included in an amount of 0.1 to 10 weight percent, based on a total weight of the cleaning composition.

EXAMPLES

General Procedure

In each Example (E) and Comparative Example (C), the cleaner was prepared using the amounts provided in Tables 4 to 10, in grams (g), by first weighing water into a glass jar, adding a stir bar, and then while stirring at 500 revolutions per minute (rpm) adding the surfactant followed by the water immiscible compound and the water miscible compound, if present. After stirring for 10 minutes, remaining components, if present, were added while stirring.

Versenex™ 80 is a 40% aqueous solution of pentasodium diethylene triamine pentaacetate and was used as received from the Dow Chemical Company.

The hydrogen Peroxide is a 35% aqueous solution.

PEG/PPG-17/6 Copolymer, product UCON™ 75-H-450, was obtained from the Dow Chemical Company.

UCON™ OSP-32 was obtained from the Dow Chemical Company.

Shake Test for Foam Generation and Collapse

After stirring, the stir bar was removed and the glass jar was capped. The glass jar was then vigorously shaken for 10 seconds. The time for foam to collapse was measured to provide a foam collapse rating according to Table 3.

TABLE 3

| Rating | Foam Stability |
|---|---|
| 10 | Greater than 5 minutes |
| 9 | 4 to 5 minutes |
| 8 | 3 to 4 minutes |
| 7 | 2 to 3 minutes |
| 6 | 1 to 2 minutes |
| 5 | 45 seconds to1 minute |
| 4 | 30 to 45 seconds |
| 3 | 15 to 30 seconds |
| 2 | 10 to 15 seconds |
| 1 | Less than 10 seconds |

The composition and foam collapse rating for Examples E1 to E45 and Comparative Examples C1 to C17 are provided in Tables 4 to 10.

TABLE 4

Example (E1) and Comparative Examples C1 to C6: Effect of Water Immiscible Compound

| Ingredient | E1 | C1 | C2 | C3 | C4 | C5 | C6 |
|---|---|---|---|---|---|---|---|
| ECOSURF ™ EH6 | 1.00 | 1.50 | 1.50 | 1.50 | 1.00 | 1.00 | 1.00 |
| Tripropylene glycol methyl ether | 1.00 | 0.50 | | | 1.00 | 1.00 | 1.00 |
| Dipropylene glycol n-propyl ether | | | 0.50 | | | | |
| Dipropylene glycol methyl ether acetate | | | | 0.50 | | | |
| Dipropylene glycol n-butyl ether | 2.00 | 2.00 | 2.00 | 2.00 | 2.00 | 2.00 | 2.00 |
| Tripropylene glycol n-butyl ether | | | | | | 1.00 | |
| Diethylene glycol hexyl ether | | | | | | | 0.50 |
| Ethyl laurate | 1.00 | | | | | | |
| Citric acid | 2.00 | 2.00 | 2.00 | 2.00 | 2.00 | 2.00 | 2.00 |
| VERSENEX ™ 80 (40%) | 0.50 | 0.50 | 0.50 | 0.50 | 0.50 | 0.50 | 0.50 |
| Hydrogen peroxide (35%) | 1.50 | 1.50 | 1.50 | 1.50 | 1.50 | 1.50 | 1.50 |
| Water | 41.00 | 42.00 | 42.00 | 42.00 | 42.00 | 41.00 | 41.50 |
| Sum (grams) | 50.00 | 50.0 | 50.00 | 50.00 | 50.00 | 50.00 | 50.00 |
| Foam Collapse Rating | 1 | 5 | 8 | 8 | 4 | 7 | 4 |

ECOSURF™ EH3, ECOSURF™ EH6, ECOSURF™ EH9, ECOSURF™ EH14, ECOSURF™ SA7 and ECOSURF™ SA15 were obtained from the Dow Chemical Company.

TRITON™ CG50, TRITON™ CG425, TRITON™ CG600, TRITON™CG650, TRITON™DF16, TRITON™ CF10, TRITON™ LF20, and TRITON™X45 were obtained from the Dow Chemical Company.

Minfoam™ 1x and Minfoam™ 2x were obtained from the Dow Chemical Company.

Tergitol™ 15-S-9 was obtained from the Dow Chemical Company.

EcoSsense™ 3000 was obtained from the Dow Chemical Company.

TABLE 5

Examples E2-E4 and Comparative Examples C7 and C8: Content of Water Immiscible Compound

| Ingredient | E2 | E3 | E4 | C7 | C8 |
|---|---|---|---|---|---|
| ECOSURF ™ EH3 | | | | | 0.5 |
| ECOSURF ™ EH6 | 1.50 | 1.50 | 1.50 | 1.50 | 1.50 |
| Tripropylene Glycol Methyl Ether | 1.00 | 1.00 | 1.00 | | |
| Dipropylene Glycol n Butyl Ether | 2.00 | 2.00 | 2.00 | 2.00 | 2.00 |
| Ethyl Laurate | 0.10 | 0.40 | 0.50 | | |

TABLE 5-continued

| Examples E2-E4 and Comparative Examples C7 and C8: Content of Water Immiscible Compound | | | | | |
|---|---|---|---|---|---|
| Ingredient | E2 | E3 | E4 | C7 | C8 |
| Citric Acid | 2.00 | 2.00 | 2.00 | 2.00 | 2.00 |
| VERSENEX ™ 80 (40%) | 0.50 | 0.50 | 0.50 | 0.50 | 0.50 |
| Hydrogen Peroxide (35%) | 1.50 | 1.50 | 1.50 | 1.50 | 1.50 |
| Water | 41.40 | 41.10 | 41.00 | 42.50 | 42.00 |
| Sum | 50.00 | 50.00 | 50.00 | 50.00 | 50.00 |
| Foam Collapse Rating | 1 | 1 | 1 | 4 | 5 |

TABLE 6

| Examples E5 to E7 and Comparative Examples C9 to C11: Water Miscible Compound | | | | | | |
|---|---|---|---|---|---|---|
| Ingredient | E5 | E6 | C9 | C10 | E7 | C11 |
| ECOSURF ™ EH6 | 1.50 | 1.50 | 1.50 | 1.50 | 1.50 | 1.50 |
| Tripropylene glycol methyl ether | | | 1.00 | 1.00 | | |
| Dipropylene glycol n-butyl ether | 2.00 | | 2.00 | | | |
| Propylene glycol n-propyl ether | | | | | 0.50 | 0.50 |
| Ethyl laurate | 0.50 | 0.50 | | | 0.50 | |
| Citric acid | 2.00 | 2.00 | 2.00 | 2.00 | 2.00 | 2.00 |
| VERSENEX ™ 80 (40%) | 0.50 | 0.50 | 0.50 | 0.50 | 0.50 | 0.50 |
| Hydrogen peroxide (35%) | 3.50 | 3.50 | 1.50 | 1.50 | 1.50 | 1.50 |
| Fragrance | | 0.10 | | | | |
| Water | 40.00 | 41.90 | 41.50 | 43.50 | 43.50 | 44.00 |
| Sum | 50.00 | 50.00 | 50.00 | 50.00 | 50.00 | 50.00 |
| Foam Collapse Rating | 1 | 7 | 8 | 9 | 7 | 9 |

TABLE 7

| Examples E8 to E13 and Comparative Examples C12 to C13: Water immiscible Compound | | | | | | | | |
|---|---|---|---|---|---|---|---|---|
| Ingredient | E8 | E9 | E10 | E11 | C12 | C13 | E12 | E13 |
| ECOSURF ™ EH6 | 1.00 | 1.00 | 1.00 | 1.00 | 1.00 | 1.00 | 1.00 | 1.00 |
| Dipropylene glycol n-butyl ether | 1.50 | 1.50 | 1.50 | 1.50 | 1.50 | 1.50 | 1.50 | 1.50 |
| PEG/PPG-17/6 Copolymer | | | | | 0.25 | | | |
| UCON ™ OSP-32 | | | | | | 0.25 | | |
| Ethyl laurate | | | 0.25 | | | | 0.25 | 0.25 |
| D-limonene | 0.25 | | | | | | | |
| Ethyl octanoate | | 0.25 | | | | | | |
| Butyl decanoate | | | | 0.25 | | | | |
| Citric acid | 2.00 | 2.00 | 2.00 | 2.00 | 2.00 | 2.00 | 2.00 | 2.00 |
| VERSENEX ™ 80 (40%) | 0.50 | 0.50 | 0.50 | 0.50 | 0.50 | 0.50 | 0.50 | 0.50 |
| Hydrogen peroxide (35%) | 1.50 | 3.50 | 3.50 | 1.50 | 1.50 | 1.50 | 1.50 | |
| Fragrance | | | | | | | 0.05 | 0.05 |
| Water | 43.25 | 41.25 | 41.25 | 43.25 | 43.25 | 43.25 | 43.20 | 44.70 |
| Sum | 50.00 | 50.00 | 50.00 | 50.00 | 50.00 | 50.00 | 50.00 | 50.00 |
| Foam Collapse Rating | 1 | 1 | 1 | 1 | 9 | 9 | 1 | 1 |

TABLE 8

| Examples E14 to E18 and Comparative Examples C14 to C17 : Water Miscible Compound | | | | | | | | | |
|---|---|---|---|---|---|---|---|---|---|
| Ingredient | E14 | E15 | E16 | E17 | E18 | C14 | C15 | C16 | C17 |
| ECOSURF ™ EH6 | 1.50 | 1.00 | 1.00 | 1.00 | 1.00 | 1.00 | 1.00 | 1.0 | 1.0 |
| Tripropylene glycol methyl ether | 1.00 | | | | | | | | |
| Dipropylene glycol n-butyl ether | 2.00 | 1.50 | 1.50 | 1.50 | 1.50 | | | | |
| Propylene glycol methyl ether | | | | | | 1.50 | 1.50 | | |
| Ethylene glycol propyl ether | | | | | | | | 1.50 | 1.50 |
| Ethyl laurate | 0.50 | 0.25 | 0.25 | | | | 0.25 | | 0.25 |
| Methyl soyate | | | | 0.25 | 0.25 | | | | |
| Citric acid | 2.00 | 2.00 | 2.00 | 2.00 | 2.00 | 2.00 | 2.00 | 2.00 | 2.00 |
| VERSENEX ™ 80 (40%) | 0.50 | 0.50 | 0.50 | 0.50 | 0.50 | 0.50 | 0.50 | 0.50 | 0.50 |
| Hydrogen peroxide (35%) | 1.50 | 3.50 | 3.50 | 1.50 | 1.50 | 1.50 | 1.50 | 1.50 | 1.50 |
| Fragrance | 0.05 | | 0.05 | | 0.05 | | | | |
| Water | 40.95 | 41.25 | 41.20 | 43.25 | 43.20 | 43.50 | 43.25 | 43.50 | 43.25 |

TABLE 8-continued

| Examples E14 to E18 and Comparative Examples C14 to C17 : Water Miscible Compound | | | | | | | | | |
|---|---|---|---|---|---|---|---|---|---|
| Ingredient | E14 | E15 | E16 | E17 | E18 | C14 | C15 | C16 | C17 |
| Sum | 50.00 | 50.00 | 50.00 | 50.00 | 50.00 | 50.00 | 50.00 | 50.00 | 50.00 |
| Foam Collapse Rating | 1 | 1 | 1 | 1 | 1 | 10 | 10 | 10 | 10 |

TABLE 9

| Examples E19 to E31: Surfactant | | | | | | | | | | | | | |
|---|---|---|---|---|---|---|---|---|---|---|---|---|---|
| Ingredient | E19 | E20 | E21 | E22 | E23 | E24 | E25 | E26 | E27 | E28 | E29 | E30 | E31 |
| ECOSURF ™ EH6 | 1.50 | | | | | | | | | | | | |
| ECOSURF ™ EH3 | | 1.50 | | | | | | | | | | | |
| ECOSURF ™ EH9 | | | 1.50 | | | | | | | | | | |
| ECOSURF ™ EH14 | | | | 1.50 | | | | | | | | | |
| ECOSURF ™ SA7 | | | | | 1.50 | | | | | | | | |
| TRITON ™ CG425 | | | | | | 1.50 | | | | | | | |
| TRITON ™ DF16 | | | | | | | 1.50 | | | | | | |
| TRITON ™ CF10 | | | | | | | | 1.50 | | | | | |
| TRITON ™ LF20 | | | | | | | | | 1.50 | | | | |
| TRITON ™ X45 | | | | | | | | | | 1.50 | | | |
| MINFOAM ™ 1x | | | | | | | | | | | 1.50 | | |
| MINFOAM ™ 2x | | | | | | | | | | | | 1.50 | |
| TERGITOL ™ 15-S-9 | | | | | | | | | | | | | 1.50 |
| Dipropylene glycol n-butyl ether | 2.00 | 2.00 | 2.00 | 2.00 | 2.00 | 2.00 | 2.00 | 2.00 | 2.00 | 2.00 | 2.00 | 2.00 | 2.00 |
| Tripropylene glycol methyl ether | 1.00 | 1.00 | 1.00 | 1.00 | 1.00 | 1.00 | 1.00 | 1.00 | 1.00 | 1.00 | 1.00 | 1.00 | 1.00 |
| Ethyl laurate | 0.50 | 0.50 | 0.50 | 0.50 | 0.50 | 0.50 | 0.50 | 0.50 | 0.50 | 0.50 | 0.50 | 0.50 | 0.50 |
| Citric acid | 2.00 | 2.00 | 2.00 | 2.00 | 2.00 | 2.00 | 2.00 | 2.00 | 2.00 | 2.00 | 2.00 | 2.00 | 2.00 |
| VERSENEX ™ 80 (40%) | 0.50 | 0.05 | 0.50 | 0.50 | 0.50 | 0.50 | 0.50 | 0.50 | 0.50 | 0.50 | 0.50 | 0.50 | 0.50 |
| Hydrogen peroxide (35%) | 1.50 | 1.50 | 1.50 | 1.50 | 1.50 | 1.50 | 1.50 | 1.50 | 1.50 | 1.50 | 1.50 | 1.50 | 1.50 |
| Water | 41.00 | 41.00 | 41.00 | 41.00 | 41.00 | 41.00 | 41.00 | 41.00 | 41.00 | 41.00 | 41.00 | 41.00 | 41.00 |
| Sum | 50.00 | 50.00 | 50.00 | 50.00 | 50.00 | 50.00 | 50.00 | 50.00 | 50.00 | 50.00 | 50.00 | 50.00 | 50.00 |
| Foam Collapse Rating | 1 | NF | 4 | 7 | 1 | NF | NF | 1 | NF | 5 | 1 | NF | 6 |

NF: No foam

TABLE 10

| Examples E32-E45: Surfactant | | | | | | | | | | | | | | |
|---|---|---|---|---|---|---|---|---|---|---|---|---|---|---|
| Ingredient | E32 | E33 | E34 | E35 | E36 | E37 | E38 | E39 | E40 | E41 | E42 | E43 | E44 | E45 |
| ECOSURF ™ EH6 | 1.50 | | | | | | | | | | | | | 1.00 |
| ECOSURF ™ SA4 | | 1.50 | | | | | | | | | | | | |
| ECOSURF ™ SA9 | | | 1.50 | | | | | | | | | | | |
| ECOSURF ™ SA15 | | | | 1.50 | | | | | | | | | | |
| TRITON ™ CG50 | | | | | 1.50 | | | | | | | | | |
| TRITON ™ CG600 | | | | | | 1.50 | | | | | | | | |
| TRITON ™ CG650 | | | | | | | 1.50 | | | | | | | |
| EcoSense ™ 3000 | | | | | | | | 1.50 | | | | | | |
| TRITON ™ CF10 | | | | | | | | | 2.00 | | | | | |

TABLE 10-continued

| Examples E32-E45: Surfactant | | | | | | | | | | | | | | |
|---|---|---|---|---|---|---|---|---|---|---|---|---|---|---|
| Ingredient | E32 | E33 | E34 | E35 | E36 | E37 | E38 | E39 | E40 | E41 | E42 | E43 | E44 | E45 |
| TERGITOL ™ 15-S-9 | | | | | | | | | | 1.00 | 1.25 | | | |
| TERGITOL ™ 15-S-7 | | | | | | | | | | | | 1.50 | | |
| Sodium Alkyl benzene sulfonate | | | | | | | | | | | | | 1.50 | 1.00 |
| Dipropylene glycol n-butyl ether | 2.00 | 2.00 | 2.00 | 2.00 | 2.00 | 2.00 | 2.00 | 2.00 | 2.00 | 2.00 | 2.00 | 2.00 | 2.00 | 2.00 |
| Tripropylene glycol methyl ether | 1.00 | 1.00 | 1.00 | 1.00 | 1.00 | 1.00 | 1.00 | 1.00 | 1.00 | 1.00 | 1.00 | 1.00 | | |
| Ethyl laurate | 0.50 | 0.50 | 0.50 | 0.50 | 0.50 | 0.50 | 0.50 | 0.50 | 0.50 | 0.50 | 0.50 | 0.50 | 0.50 | 0.50 |
| Citric acid | 2.00 | 2.00 | 2.00 | 2.00 | 2.00 | 2.00 | 2.00 | 2.00 | 2.00 | 2.00 | 2.00 | 2.00 | 2.00 | 2.00 |
| VERSENEX ™ 80 (40%) | 0.50 | 0.50 | 0.50 | 0.50 | 0.50 | 0.50 | 0.50 | 0.50 | 0.50 | 0.50 | 0.50 | 0.50 | 0.50 | 0.50 |
| Hydrogen peroxide (35%) | 1.50 | 1.50 | 1.50 | 1.50 | 1.50 | 1.50 | 1.50 | 1.50 | 1.50 | 1.50 | 1.50 | 1.50 | 1.50 | 1.50 |
| Water | 41.00 | 41.00 | 41.00 | 41.00 | 41.00 | 41.00 | 41.00 | 41.00 | 40.50 | 41.50 | 41.25 | 41.00 | 42.00 | 41.50 |
| Sum | 50.00 | 50.00 | 50.00 | 50.00 | 50.00 | 50.00 | 50.00 | 50.00 | 50.00 | 50.00 | 50.00 | 50.00 | 50.00 | 49.00 |
| Foam Collapse Rating | 1 | NF | 5 | 8 | NF | NF | NF | NF | NF | 1 | 1 | 5 | 6 | 6 |

NF: No foam

Hard Surface Cleaning Analysis

Evaluation of hard surface cleaning was performed using a sheen test in accordance with Consumer Specialty Products Association (CSPA) method DC-17, the content of that is incorporated herein by reference in its entirety, available from The Consumer Specialty Products Association of Washington D.C. Tiles were stained with milk, lard, olive oil, bandy clay and carbon black according to CSPA method DC-17. Next, 2 milliliters (mL) of the formulations provided in Tables 11 and 12 were applied to stained tiles using a Sheen machine and the tile surface sponge wiped 10 times to provide 5 complete cycles. Cleaned tiles were rated on a 1 to 10 scale, 1 being poor and 10 being clean.

TABLE 11

| Examples E46 to E49 and Comparative Examples C18 to C20 | | | | | | |
|---|---|---|---|---|---|---|
| Ingredient | E46 | E47 | C18 | E49 | C19 | C20 |
| ECOSURF ™ EH3 | | | | | | 0.50 |
| ECOSURF ™ EH6 | 1.50 | 1.50 | 1.00 | 1.50 | 1.50 | 1.50 |
| Tripropylene glycol methyl ether | 1.00 | 1.00 | 1.00 | 1.00 | | |
| Dipropylene glycol n-butyl ether | 2.00 | 2.00 | 2.00 | 2.00 | 2.00 | 2.00 |
| Diethylene glycol n-butyl ether | | | 1.00 | | | |
| Ethyl laurate | 0.10 | 0.50 | | 0.40 | | |
| Citric acid | 2.00 | 2.00 | 2.00 | 2.00 | 2.00 | 2.00 |
| VERSENEX 80 (40%) | 0.50 | 0.50 | 0.50 | 0.50 | 0.50 | 0.50 |
| Hydrogen peroxide (35%) | 1.50 | 1.50 | 1.50 | | 1.50 | 1.50 |
| Water | 41.40 | 41.00 | 41.00 | 42.60 | 42.50 | 42.00 |
| Sum | 50.00 | 50.00 | 50.00 | 50.00 | 50.00 | 50.00 |
| Cleaning Scale, 1 = poor and 10 = clean | 9 | 8 | 9 | 7 | 8 | 5 |

TABLE 12

| Examples E50 to E51 and Comparative Examples C21 to C24 | | | | | | |
|---|---|---|---|---|---|---|
| Ingredient | C21 | E50 | C22 | C23 | C24 | E51 |
| ECOSURF ™ EH6 | 1.00 | 1.00 | 1.00 | 1.00 | 1.00 | 1.00 |
| Tripropylene glycol methyl ether | 1.00 | | | 2.00 | | |
| Dipropylene glycol n-butyl ether | 2.00 | 1.50 | | | | |
| Propylene glycol n-propyl ether | | | | | 2.00 | 2.00 |
| Ethyl laurate | | 0.25 | 1.50 | | | 0.25 |
| Citric acid | 2.00 | 2.00 | 2.00 | 2.00 | 2.00 | 2.00 |
| VERSENEX 80 (40%) | 0.50 | 0.50 | 0.50 | 0.50 | 0.50 | 0.50 |
| Hydrogen peroxide (35%) | 1.50 | 3.50 | 3.50 | 1.50 | 1.50 | 1.50 |
| Water | 42.00 | 41.25 | 41.50 | 43.00 | 43.00 | 42.75 |
| Sum | 50.00 | 50.00 | 50.00 | 50.00 | 50.00 | 50.00 |
| Cleaning Efficiency 1 = Poor; 10 = Clean | 9 | 9 | 8 | 8 | 9 | 8 |

What is claimed is:

1. An aqueous foaming cleaning composition comprising:

a nonionic alkoxylated surfactant that is a condensation product of an alcohol having a 2-ethyl hexyl group and 2 to 9 moles of ethylene oxide and propylene oxide per molecule of the alcohol, wherein the nonionic surfactant has a hydrophilic-lipophilic balance of 8.5 to 13.5;

a first compound comprising ethyl octanoate, butyl octanoate, ethyl decanoate, butyl decanoate, ethyl laurate, or a combination thereof; and a second compound that is miscible with water and has Hansen solubility parameters of 14 $MPa^{0.5} \leq \delta_D \leq 17$ $MPa^{0.5}$, $1 \leq \delta_P \leq 7$ $MPa^{0.5}$, and $7 \leq \delta_H \leq 12$ $MPa^{0.5}$, wherein the surfactant, the first compound, and the second compound are each independently included in an amount of 0.2 to 8 weight percent, based on a total weight of the cleaning composition.

2. The cleaning composition of claim 1, wherein the surfactant has a hydrophilic-lipophilic balance of 9 to 13.

3. The cleaning composition of claim 1, further comprising a substituted or unsubstituted terpene.

4. The cleaning composition of claim 1, wherein the second compound comprises a compound of Formula 2, $$R^3—(OC_nH_{2n})_zOX \quad (2)$$

wherein $R^3$ is a substituted or unsubstituted C1 to C12 aliphatic group, a substituted or unsubstituted C6 to 12 aryl group, a group of the formula $—C(=O)C_6H_5$, or a group of the formula $—C(=O)CH_3$, n is 2 to 12, z is 1 to 4, and X is —H, $—CH_3$, $—C(=O)CH_3$, or $—C(=O)C_6H_5$.

5. The cleaning composition of claim 1, wherein the second compound comprises a compound of Formula 2, $$R^3—(OC_nH_{2n})_zOX \quad (2)$$

wherein $R^3$ is a substituted or unsubstituted C1 to C12 aliphatic group, a substituted or unsubstituted C6 to C12 aryl group, a group of the formula $—C(=O)C_6H_5$, or a group of the formula $—C(=O)CH_3$, n is 2 to 4, z is 1 to 4, and X is —H, $—CH_3$, $—C(=O)CH_3$, or $—C(=O)C_6H_5$.

6. The cleaning composition of claim 4, wherein $R^3$ is an unsubstituted C2 to C6 alkyl group, n is 2 to 4, and z is 1 to 3.

7. The cleaning composition of claim 1, wherein the first compound and the second compound each independently have a molecular weight of 80 to 750 Daltons.

8. A method of manufacturing an aqueous cleaning composition, the method comprising combining a nonionic alkoxylated surfactant that is a condensation product of an alcohol having a 2-ethyl hexyl group and 2 to 9 moles of ethylene oxide and propylene oxide per molecule of the alcohol, wherein the nonionic surfactant has a hydrophilic-lipophilic balance of 8.5 to 13.5;

a first compound comprising ethyl octanoate, butyl octanoate, ethyl decanoate, butyl decanoate, ethyl laurate, or a combination thereof; and a second compound that is water miscible and has Hansen solubility parameters of 14 $MPa^{0.5} \leq \delta_D \leq 17$ $MPa^{0.5}$, $1 \leq \delta_P \leq 7$ $MPa^{0.5}$, and $7 \leq \delta_H \leq 12$ $MPa^{0.5}$; to manufacture the cleaning composition;

wherein the surfactant, the first compound, and the second compound are each independently included in an amount of 0.2 to 8 weight percent, based on a total weight of the cleaning composition.

9. A method of cleaning a surface comprising contacting the surface with the cleaning composition of claim 1 to form a foam having a foam stability from 0 to less than 30 seconds, as measured by the elapsed time to foam collapse; and removing soil and the cleaning composition from the surface.

10. The method of claim 9, further comprising a substituted or unsubstituted terpene.

11. The cleaning composition of claim 1, wherein the nonionic alkoxylated surfactant comprises a 2-ethyl hexanol ethylene oxide-propylene oxide non-ionic surfactant.

12. An aqueous foaming cleaning composition comprising:

a nonionic alkoxylated surfactant that is a condensation product of an alcohol having an alkyl group containing 6 to 20 carbon atoms and 2 to 9 moles of both of ethylene oxide and propylene oxide per molecule of the alcohol, wherein the nonionic surfactant has a hydrophilic-lipophilic balance of 8.5 to 13.5;

a first compound comprising ethyl octanoate, butyl octanoate, ethyl decanoate, butyl decanoate, ethyl laurate, or a combination thereof; and a second compound that is miscible with water and has Hansen solubility parameters of 14 $MPa^{0.5} \leq \delta_D \leq 17$ $MPa^{0.5}$, $1 \leq \delta_P \leq 7$ $MPa^{0.5}$, and $7 \leq \delta_H \leq 12$ $MPa^{0.5}$, wherein the surfactant, the first compound, and the second compound are each independently included in an amount of 0.2 to 8 weight percent, based on a total weight of the cleaning composition.

* * * * *